United States Patent [19]

Hellström

[11] Patent Number: 4,784,189

[45] Date of Patent: Nov. 15, 1988

[54] DEVICE FOR SURVEYING THE INSERTION OF A WEFT YARN

[75] Inventor: Jerker Hellström, Nol, Sweden

[73] Assignee: Aktiebolaget IRO, Ulricehamn, Sweden

[21] Appl. No.: 165,375

[22] Filed: Feb. 29, 1988

Related U.S. Application Data

[63] Continuation of Ser. No. 56,551, May 29, 1987.

[30] Foreign Application Priority Data

May 30, 1986 [EP] European Pat. Off. ..... 86 107377.3

[51] Int. Cl.[4] ..... D03D 47/34

[52] U.S. Cl. ..... 139/370.2; 139/452

[58] Field of Search ..... 139/450, 452, 370.2, 139/370.1; 242/47.01, 47.02

[56] References Cited

U.S. PATENT DOCUMENTS

| | | | |
|---|---|---|---|
| 4,541,462 | 9/1985 | Tholander . | |
| 4,556,088 | 12/1985 | Tanaka et al. | 139/370.2 |
| 4,558,723 | 12/1985 | Tanaka et al. | 139/452 |
| 4,595,039 | 6/1986 | Tholander . | |
| 4,607,668 | 8/1986 | Tholander | 139/452 |
| 4,617,971 | 10/1986 | Hellstroem | 139/370.2 |
| 4,627,474 | 12/1986 | Tholander . | |

FOREIGN PATENT DOCUMENTS

| | | |
|---|---|---|
| 0004836 | 10/1979 | European Pat. Off. . |
| 0107110 | 5/1984 | European Pat. Off. . |
| 0164773 | 12/1985 | European Pat. Off. . |
| 84/02360 | 6/1984 | World Int. Prop. O. . |

*Primary Examiner*—Henry S. Jaudon

*Attorney, Agent, or Firm*—Flynn, Thiel, Boutell & Tanis

[57] ABSTRACT

A device for surveying the insertion of a weft yarn in a shed of a jet loom, comprises an arrival sensor arranged at one end of said shed for detecting the arrival of weft yarn there. The arrival sensor and at least one yarn sensor are connected to a surveillance circuit measuring the period of time lapsed since releasing a stopping device and periodically correcting the measured period of time on the basis of the yarn sensor signal. The surveillance circuit only generates a signal indicating the completion of the weft yarn insertion if the following two conditions are simultaneously fulfilled: The measured period of time exceeds a predetermined period of time between 80% and 99.5% of the period of time required for a complete weft yarn insertion cycle, and the arrival sensor generates a signal representing the arrival of the weft yarn.

10 Claims, 1 Drawing Sheet

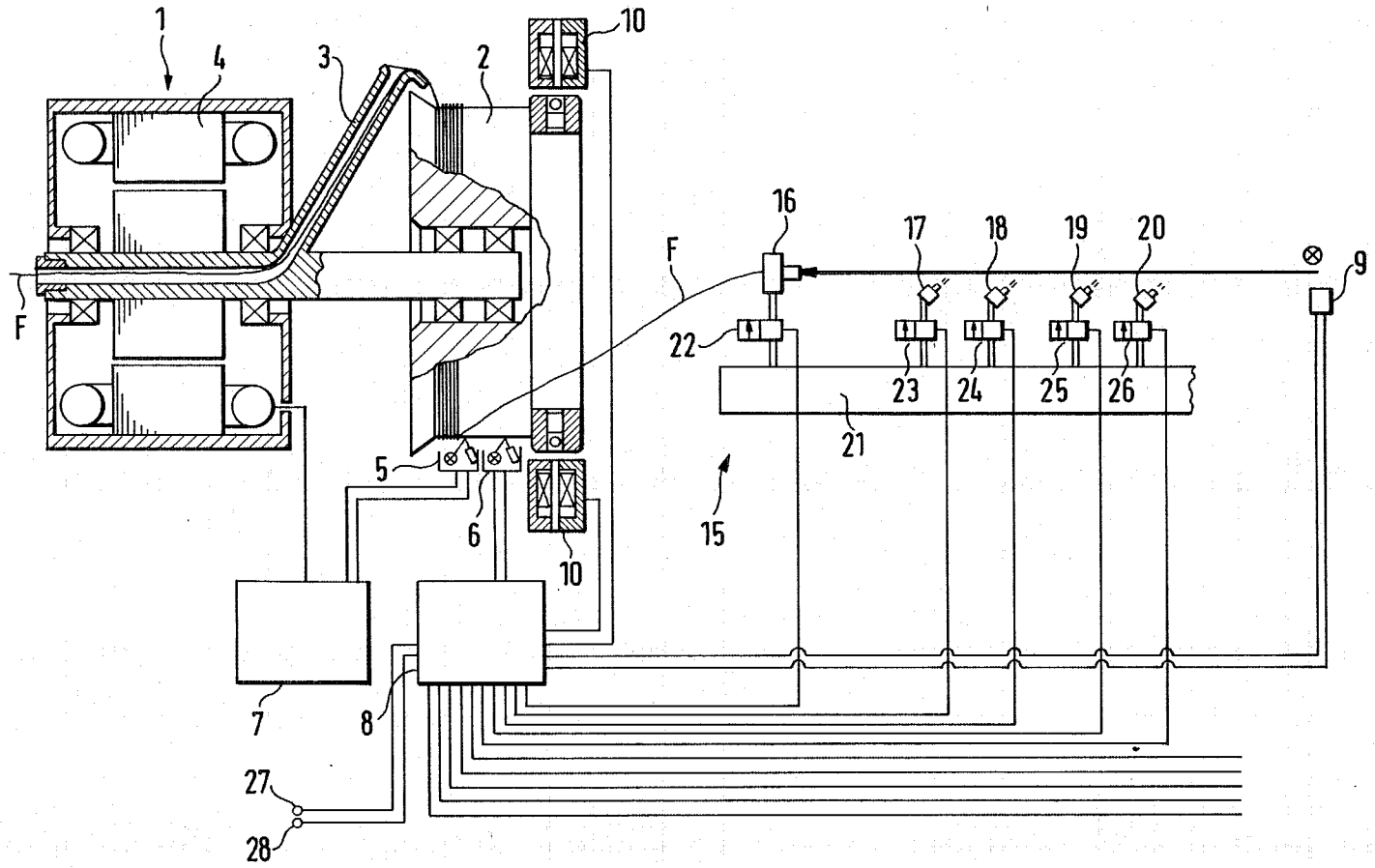
9
20
19
18
17
16
26
25
24
23
21
22
15
F
10
10
2
6
5
3
8
7
27
28
4
1
F

DEVICE FOR SURVEYING THE INSERTION OF A WEFT YARN

This application is a continuation of U.S. Ser. No. 056,551, filed May 29, 1987.

FIELD OF THE INVENTION

The present invention relates to a device for surveying the insertion of weft yarn in a shed of a jet loom.

BACKGROUND OF THE INVENTION

Jet weaving machines are usually equipped with a series of nozzles which can be sequentially actuated for guiding a weft yarn through the shed. The respective length of the weft yarn inserted in the course of one weft yarn insertion shot is determined by a yarn feeding and measuring device adapted for intermittently storing a necessary quantity of yarn for the weft yarn insertion on a storage drum thereof. The feeding device serves not only for intermittently storing the yarn, but is also for terminating the weft yarn insertion procedure by actuating a stopping device for preventing any further withdrawal of yarn from the storage drum of the feeding device. Feeding devices are known per se in the art. Feeding devices adapted for jet looms are, for example, known from the European patent application No. 83 109 818.1-2304 (and corresponding U.S. Pat. No. 4,627,474), which is owned by the applicant. The content of this prior application of the applicant is incorporated into the present application by this cross-reference.

Jet looms usually have an opto-electric sensor unit arranged at one end of the shed for detecting the arrival of the weft yarn. The sensor is used for checking whether the weft yarn has arrived at the other end of the shed, which indicates that the weft yarn insertion is terminated. The yarn arrival sensor can also be used for detecting any weft yarn insertion faults, like a weft yarn breakage in the ccurse of the insertion of the weft yarn into the shed, or other faults which can be detected by checking whether a sensor signal is generated at the end of each weft yarn insertion cycle or not. Prior art looms making use of an arrival sensor are, for example, known from U.S. Pat. No. 4,270,579 and from the European patent application EP-A- No. 164 773. The content of these prior art references are alos incorporated herein by cross-referring to these references.

As indicated above, the prior art devices make use of the sensor signal as generated by the opto-electric arrival sensor, so as to survey whether the weft yarn has been correctly inserted into the shed of the jet weaving machine or jet loom. A missing signal indicating the arrival of the weft yarn is an indication that some fault has occurred, which fault prevents the forward end of the yarn from arriving at the other end of the shed. A possible fault of this kind is, for example, a yarn breakage. This information concerning the non-arrival of the weft yarn at the end of the shed is fed to a control unit for stopping the operation of the loom if this specific fault occurs. Moreover, a weft yarn arrival at the end of the shed which takes place too early, is also an indication of the erroneous weft yarn insertion. Thus, an arrival sensor signal which is generated too early is also an indication of a weft yarn insertion fault. Hence, a too short insertion time between the departure of the weft thread at the insertion end of the shed, and the arrival of the head of the weft yarn at the other end of the shed, is also used for interrupting the operation of the jet loom. Moreover, the timing of the arrival of the weft yarn head at the arrival sensor is often used for adjusting other loom operations, like the timing of the respective actuations of the jet nozzles for adapting it to the yarn movement.

It has turned out that the arrival sensor tends to generate erroneous arrival signals. This misbehaviour is caused, for example, by particles of dust and lint in the detection area of the arrival sensor between the light source thereof and the photoelectric detection element thereof. When reducing the sensitivity of the arrival sensor for preventing an erroneous detection of the weft yarn arrival, caused by dust or lint in the detection area, the tendency to non-detect the arrival of light and thin yarn ends increases. Hence, the adjustment of the sensitivity of the arrival sensor must be chosen such that the sensitivity versus erroneous detections caused by dust or lint is lowered, while still having a sufficient sensitivity for detecting the arrival of yarn at the arrival end. Nevertheless, a certain percentage of mis-detections could not be avoided and resulted in an erroneous interruption of the weaving process.

In view of this state of art, the present invention is based on the technical task, to further enhance a device surveying the insertion of a weft yarn in a shed of a jet loom, comprising an arrival sensor for detecting the arrival of the weft yarn at one end of the shed of the jet loom, so that the reliability of the detection of the arrival of the weft yarn is increased.

In accordance with the present invention, the arrival sensor, and at least one yarn sensor, located in the vicinity of a withdrawal end of a storage drum of the yarn feeding device, are connected to a survellance circuit for generating a signal indicating the completion of the insertion of the weft yarn into the shed. The yarn sensor located in the vicinity of the withdrawal end of the storage drum serves to generate a pulse signal indicating that the yarn passes the sensor detection area during the withdrawal of the yarn from the storage drum. Hence, the pulse signal can be used for detecting the actual velocity of the yarn withdrawal from the drum. The surveillance circuit measures the period of time lapsed since releasing a stopping device at the beginning of the weft yarn insertion cycle and periodically adjusts the measured period of time on the basis of the yarn sensor signal. Hence the measured period of time is continuously adjusted to the dynamic weft yarn withdrawal operation. Thus, the dynamically corrected measured period of time is an optimal representation of the actual position which the weft yarn had. The surveillance circuit only generates a signal indicating the completion of the weft yarn insertion, if two conditions are simultaneously fulfilled:

(1) the measured and corrected period of time exceeds a predetermined period of time between 80% and 99.5% of the period of time required for a complete weft yarn insertion cycle, and (2) an arrival sensor signal is generated.

Alternatively, the dynamically adjusted value as periodically measured and corrected by the surveillance circuit can be a calculated length of the weft yarn withdrawn from the storage drum, 7, instead of the measured and corrected period of time. Advantages and details of the design of the respective devices in reference to the drawing.

BRIEF DESCRIPTION OF THE DRAWINGS

The only FIGURE shows a side view of a yarn feeding device and of a jet loom which is equipped with a yarn arrival sensor.

DETAILED DESCRIPTION

A feeding device 1 consists of a storage drum 2, a winding-on device 3, which may have the form of an orbiting feeder tube 3, and an electric motor 4. A yarn F being supplied to the orbiting feeder tube 3, driven by the electric motor 4, is wound on to the storage drum 2. This storage drum is a stationary storage drum, which is maintained in a stationary position with respect to its environment by magnetic means (not shown here). The feeding device 1 is provided with a storage sensor 5, located close to the cylindrical surface of the storage drum 2. The storage sensor 5 consists of a light-emitting device and a light-sensing device, generating a signal indicating the amount of yarn stored on the drum. Based on this signal, a storage control unit 7 controls the rotational speed of the electric motor 4 such that a sufficient amount of yarn remains available on the storage drum 2.

A yarn sensing means 6, located at the withdrawal end of the storage drum 2, is arranged so that the yarn withdrawn from the storage drum 2, passes it detection area. The yarn sensing means 6 is not necessarily located at the withdrawal end of the storage drum, but can also be located spaced apart from the storage drum in the vicinity of the insertion end of a jet loom. It is only necessary that the yarn sensing means is arranged so that it generates a signal which is indicative of the number of turns withdrawn from the storage drum, or that it is alternatively indicative of the yarn speed itself. For example, sensor signals generated by sensors located in the shed along the path of the yarn are suitable for determining the yarn speed.

The yarn sensing means 6 preferably consists of a single yarn sensor 6, generating a pulse signal, each pulse indicating that the yarn passes a detection area of the yarn sensor 6. A yarn stopping device 10 is located at the withdrawal end of the storage drum 2. There can also be a plurality of stopping devices located at regular angular intervals around the storage drum 2.

The technique of the feeding device 1 described above is described in detail in the European patent application No. 83 109 818.1-2304 of the applicant. A jet loom 15 includes a main jet nozzle 16 and a plurality of relay nozzles 17 to 20. The respective nozzles 16 to 20 are supplied with compressed air from a source of compressed air 21 via solenoid valves 22 to 26.

A yarn F withdrawn from the storage drum 2 is fed to the main jet nozzle 16 of the jet loom 15, and guided by a jet of compressed air generated by sequentially actuating the main jet nozzle and the respective relay jet nozzles through the shed of the jet loom. An arrival of the head of the weft yarn is detected by an arrival sensor 9 arranged at the arrival end of the shed of the jet loom 15. The arrival sensor 9, the yarn sensor 6, the respective yarn stopping devices 10 and the respective jet nozzles 16 to 20 are connected to the surveillance circuit 8. The surveillance circuit 8 may be a standard microprocessor of the type 8748, manufactured by the "INTEL" Corporation.

The FIGURE shows only four relay nozzles 17 to 20 connected to the surveillance circuit 8. However, practical embodiments of the jet loom are usually equipped with about 16 nozzles, each being connected to the surveillance circuit 8 for being sequentially activated and de-activated in the course of the weft yarn insertion. Hereinafter, the surveillance of the weft yarn insertion process is described in more detail.

At the very beginning of one weft yarn insertion cycle, the stopping device 10 is released for allowing the weft yarn to be withdrawn from the storage drum 2. The surveillance circuit 8 measures a period of time expiring since the releasing of the stopping device, or calculates a value representing the actual length of weft yarn withdrawn from the storage drum 2 on the basis of the time lapsed since releasing the stopping device 10.

Shortly after releasing the stopping device 10, the yarn passes the detection area of the yarn sensor 6, which in turn generates a pulse signal. Upon receipt of said pulse signal, the surveillance circuit adjusts the measured period of time or the value representing the actual length of yarn withdrawn from the storage drum. This periodical correction can be carried out by stopping the increasing of the actual value of the measured period of time which may also be regarded as a representation of the actual length of the weft yarn withdrawn from the storage drum after having increased said value for a certain amount. Thereinafter, the value is maintained until a pulse from the yarn sensor 6 is received. Afterwards, this value representing the period of time or representing the actual length of weft yarn withdrawn from the storage drum, is again continuously increased.

This periodical dynamic correction of the calculated period of time or of the calculated length of yarn withdrawn from the drum will be described later.

The surveillance circuit 8 disregards any arrival sensor signal which is generated before the calculated period of time corresponding to the calculated length of yarn withdrawn from the drum exceeds a predetermined period of time corresponding to a predetermined length. The predetermined period of time is pre-set to be 80% to 99.5%, preferably between 95 and 99.5% of the period of time required for a complete weft yarn insertion. Similarly, the value which may be regarded as a predetermined pre-set length is between 80% and 99.5% preferably between 95 and 99.5% of the overall weft yarn length. The surveillance circuit 8 generates a completion signal indicating the completion of the insertion procedure only if the following two conditions are simultaneously fulfilled:

(1) the measured and corrected period of time corresponding to the calculated length exceeds said predetermined period of time or predetermined length corresponding to 80% to 99.5% of the period of time required for a complete weft yarn insertion cycle, or corresponding to 80% to 99.5% of the overall length of the weft yarn for one complete shot; and the arrival sensor 9 generates a signal representing the arrival of (2) the weft yarn there. The signal indicating the completion of the insertion of the weft yarn into the shed which is generated by the surveillance circuit 8, if both of the above conditions are simultaneously fulfilled, is fed to an output terminal 27.

If no arrival sensor signal is fed to the surveillance circuit between the moment when the measured and corrected period of time exceeds said predetermined period of time, and the moment when the measured and corrected period of time exceeds the period of time required for the complete weft yarn insertion, the surveillance circuit 8 generates a fault signal, indicating that the weft yarn has not arrived in time at the arrival sensor 9. The fault signal is fed to an output terminal 28 of the surveillance circuit 8.

Hereinafter, a preferred mode of operation of the surveillance circuit for adapting the internal time basis to the actual dynamic withdrawal procedure, and for disenabling or enabling the generation of an output signal indicating the completion of the weft yarn insertion procedure upon receipt of an arrival sensor signal, dependent on said internal time basis, will be described.

This internal time basis can also be considered as an internal representation of a calculated yarn withdrawal length. The surveillance circuit resets a value corresponding to the measured period of time, or corresponding to the calculated length of withdrawn yarn, to zero, when releasing or de-actuating the stopping device 10.

Afterwards, said value corresponding to the measured period of time or corresponding to the calculated length, is increased with a predetermined rate which is chosen to be slightly above the actual withdrawal velocity. While increasing said value, the surveillance circuit checks (bi) whether said value equals a predetermined value, corresponding to said predetermined time or a predetermined value, corresponding to said predetermined time or a predetermined length, corresponding to 80% to 99.5% of the overall weft yarn insertion time for one weft yarn shot, or corresponding to 80% to 99.5% of the overall weft yarn length for said weft yarn shot. The surveillance circuit further checks (bii) whether said value equals a pre-set value corresponding to a pre-set time or withdrawal length which is chosen so that it is a few percent, preferably 10%, smaller than the period of time lapsing during the withdrawal of one turn of yarn from the storage drum, or that it is smaller than the length of one turn of yarn. In addition, the surveillance circuit further checks whether said value equals said pre-set value multiplied by a whole number greater than 0.

If the arrival sensor generates an arrival signal as long as the first condition (bi) is fulfilled, the surveillance circuit generates a signal indicating the completion of the weft yarn insertion. Any arrival sensor signals which are generated whilst the first condition is not fulfilled, will be disregarded.

If the latter condition (bii) is fulfilled, the surveillance circuit holds the measured value and thereinafter continuously checks whether the yarn sensor 6 generates the next pulse signal. Upon receipt of said signal, the surveillance circuit returns to the step of continuously incrementing the value corresponding to the measured period of time or corresponding to the calculated weft yarn length.

The present invention is not limited to the above described concise way of adapting the internal time basis to the dynamic weft yarn withdrawal procedure. Any calculation method for adapting the internal time basis to the dynamic procedure making use of periodically determined yard speed values can also be used. For example, it is also possible to adjust the calculated internal time basis on the basis of the measured period of time between two subsequent pulses generated by the yarn sensor 6.

What is claimed is:

1. Device for surveying the insertion of a weft yarn in a shed of a jet loom, comprising an arrival sensor arranged at one end of said shed for detecting the arrival of the weft yarn, the improvement wherein:

said arrival sensor and at least one yarn sensor, the yarn sensor being located in the vicinity of the withdrawal end of a drum of a yarn feeding device for generating a pulse signal indicating that the yarn passes its detection area during the withdrawal of the yarn from the drum, are connected to a surveillance circuit for generating a completion signal indicating the completion of the insertion of said weft yarn into said shed;

said surveillance circuit measures the period of time lapsed since releasing a stopping device;

said surveillance circuit periodically corrects said measured period of time on the basis of said yarn sensor pulse signal;

said surveillance circuit generates said completion signal, indicating the completion of the weft yarn insertion, if both of the two following conditions are fulfilled:

(1) said measured and corrected period of time exceeds a predetermined period of time, said predetermined period of time is set to be 80% to 99.5% of the period of time required for a complete weft yarn insertion, and (2) said arrival sensor generates a signal representing the arrival of the weft yarn.

2. A device as claimed in claim 1, wherein:

said surveillance circuit generates a fault signal if no arrival sensor signal is generated between the moment when said measured and corrected period of time exceeds said predetermined period of time and the moment when said measured and corrected period of time exceeds said period of time required for the complete weft yarn insertion.

3. A device as claimed in claim 2, wherein the surveillance circuit measures the period of time between two subsequent pulse signals received from said yarn sensor for correcting the measured period of time.

4. A device as claimed in claim 1, wherein:

said surveillance circuit measures the period of time between two subsequent pulse signals received from said yarn sensor for correcting the measured period of time.

5. Device as claimed in claim 1, wherein:

(a) said surveillance circuit resets said measured period of time to 0 when releasing or de-actuating the stopping device, (b) said surveillance circuit increments said measured period of time with a predetermined rate and checks:

(bi) whether said measured period of time equals said predetermined time corresponding to 80 to 99.5% of the period of time required for one weft yarn insertion shot, or (bii) whether said measured period of time equals a pre-set time being chosen so that it is a few percent, preferably about 10%, smaller than the period of time lapsing during the withdrawal of one turn of yarn from the storage drum, or whether it equals said pre-set time multiplied by a whole number greater than 0, (c) said surveillance circuit generates the completion signal indicating the completion of the weft yarn insertion, if condition (bi) is fulfilled, and if the arrival sensor signal is generated, (d) said surveillance circuit holds said measured period of time equal to the pre-set time or to a whole multiple thereof, it condition (bii) is fulfilled, (e) said surveillance circuit then checks whether the yarn sensor generates the next pulse signal, and (f) the surveillance circuit returns to step (b) as soon as condition (e) is fulfilled.

6. Device for surveying the insertion of a weft yarn in a shed of a jet loom, comprising an arrival sensor arranged at one end of said shed for detecting the arrival of the weft yarn, the improvement wherein:

said arrival sensor and at least one yarn sensor, the yarn sensor being located in the vicinity of a withdrawal end of a drum of a yarn feeding device for generating a pulse signal indicating that the yarn passes its detection area during the withdrawal of the yarn from the drum, are connected to a surveillance circuit for generating a completion signal indicating the completion of the insertion of said weft yarn into said shed;

said surveillance circuit calculates the actual length of the weft yarn withdrawn from said drum on the basis of the time lapsed since releasing a stopping device;

said surveillance circuit periodically corrects said calculated length on the basis of said yarn sensor pulse signal;

said surveillance circuit generates said completion signal indicating the completion of said weft yarn insertion if both of the following two conditions are fulfilled:

(1) said calculated length exceeds a predetermined length, said predetermined length is set to be between 80% and 99.5% of the overall weft yarn length for one weft yarn shot, and (2) said arrival sensor generates a signal representing the arrival of the weft yarn.

7. Device as claimed in claim 6, wherein:

said surveillance circuit generates a fault signal, if no arrival sensor signal is generated between the moment when the actual length exceeds said predetermined length and the moment when said actual length exceeds said overall yarn length for a complete weft yarn shot.

8. A device as claimed in claim 7, wherein said surveillance circuit measures the period of time between the subsequent pulse signals received from the yarn sensor for correcting said calculated length.

9. Device as claimed in claim 6 wherein:

said surveillance circuit measures the period of time between two subsequent pulse signals received from the yarn sensor for corercting said calculated length.

10. Device as claimed in claim 6, wherein:

(a) said surveillance circuit resets said calculated length to 0 when releasing or de-actuating the stopping device, (b) said surveillance circuit increment said calculated length with a predetermined rate and checks, (bi) whether said calculated length equals said predetermined length corresponding to 80 to 99.5% of the length required for one weft yarn shot, or (bii) whether said calculated length equals a pre-set length being chosen so that it is a few percent, preferably about 10%, smaller than the length of one turn of yarn on said storage drum, or whether it equals said pre-set length multiplied by a whole number greater than 0, (c) said surveillance circuit generates the completion signal indicating the completion of the weft yarn insertion, if condition (bi) is fulfilled, and if the arrival sensor signal is generated, (d) said surveillance circuit holds said measured length, being equal to the pre-set length or to a whole multiple thereof, if condition (bii) is fulfilled, (e) said surveillance circuit then checks whether the yarn sensor generates the next pulse signal, and (f) the surveillance circuit thereinafter returns to step (b) as soon as condition (e) is fulfilled.

* * * * *